US005458183A

United States Patent [19]

Matsushima et al.

[11] Patent Number: 5,458,183

[45] **Date of Patent: * Oct. 17, 1995**

[54] HORIZONTAL CONTINUOUS CASTING METHOD AND APPARATUS

[75] Inventors: Tatsuhito Matsushima; Seishiro Saita; Masayuki Inoue; Hiroyuki Nakashima; Shogo Matsumura; Hiroshi Iwasaki; Ryuuzou Hanzawa; Katsuhiko Kawamoto; Haruo Ohguro; Yukio Morimoto; Toshihiro Kosuge, all of Hikari, Japan

[73] Assignee: Nippon Steel Corporation, Tokyo, Japan

[ * ] Notice: The portion of the term of this patent subsequent to Aug. 9, 2011 has been disclaimed.

[21] Appl. No.: 226,370

[22] Filed: Apr. 12, 1994

Related U.S. Application Data

[63] Continuation of Ser. No. 793,356, filed as PCT/JP91/00613, May 9, 1991, abandoned.

[30] Foreign Application Priority Data

| | | | |
|---|---|---|---|
| May 9, 1990 | [JP] | Japan | 2-117664 |
| Jun. 7, 1990 | [JP] | Japan | 2-147407 |
| Jul. 3, 1990 | [JP] | Japan | 2-070392 U |
| Feb. 6, 1991 | [JP] | Japan | 3-015422 |
| Feb. 27, 1991 | [JP] | Japan | 3-033177 |

[51] Int. Cl.[6] ..... B22D 11/00

[52] U.S. Cl. ..... 164/474; 164/440; 164/490

[58] Field of Search ..... 164/440, 474, 164/475, 490, 415, 253

[56] References Cited

U.S. PATENT DOCUMENTS

| | | | |
|---|---|---|---|
| 2,951,271 | 9/1960 | Tessmann | 164/440 |
| 3,307,229 | 3/1967 | Dore | 164/440 |
| 3,329,200 | 7/1967 | Craig | 164/440 |
| 3,857,437 | 12/1974 | Watts | 164/440 |
| 4,520,860 | 6/1985 | Haissig | 164/440 |
| 4,541,478 | 8/1985 | Schubert | 164/440 |
| 4,640,335 | 2/1987 | Clark | 164/440 |
| 4,774,996 | 10/1988 | Ahrens | 164/440 |
| 4,817,701 | 4/1989 | Stevens | 164/440 |

FOREIGN PATENT DOCUMENTS

| | | | |
|---|---|---|---|
| 0153014 | 8/1985 | European Pat. Off. . | |
| 53-88630 | 8/1978 | Japan . | |
| 58-74256 | 5/1983 | Japan . | |
| 58-168457 | 10/1983 | Japan . | |
| 59-66959 | 4/1984 | Japan . | |
| 61-32104 | 7/1986 | Japan . | |
| 6438136 | 11/1987 | Japan . | |
| 62-183947 | 11/1987 | Japan . | |
| 335848 | 2/1991 | Japan | 164/440 |

*Primary Examiner*—Mark Rosenbaum
*Assistant Examiner*—James Miner
*Attorney, Agent, or Firm*—Pollock, Vande Sande & Priddy

[57] ABSTRACT

A continuous casting method includes the steps of continuously supplying molten metal into a mold through at least one feed nozzle connected to the mold through a break ring, with the feed nozzle, the mold and the break ring forming at least a portion of a continuous casting apparatus, and intermittently withdrawing a cast piece formed from the molten metal in the mold thereby creating pressure in a space formed at a connecting point between the break ring, the mold and the cast piece as a result of the withdrawal from the mold. A shield means is placed to seal-off space between the at least one feed nozzle, and the mold to prevent entry of gas into the continuous casting apparatus and the pressure is reduced in the sealed-off space to thereby eliminate a pressure differential between the pressure in the sealed-off space and the pressure created in the space formed at the connecting point between the break ring, the mold and the cast piece during the intermittent withdrawal from the mold.

23 Claims, 8 Drawing Sheets

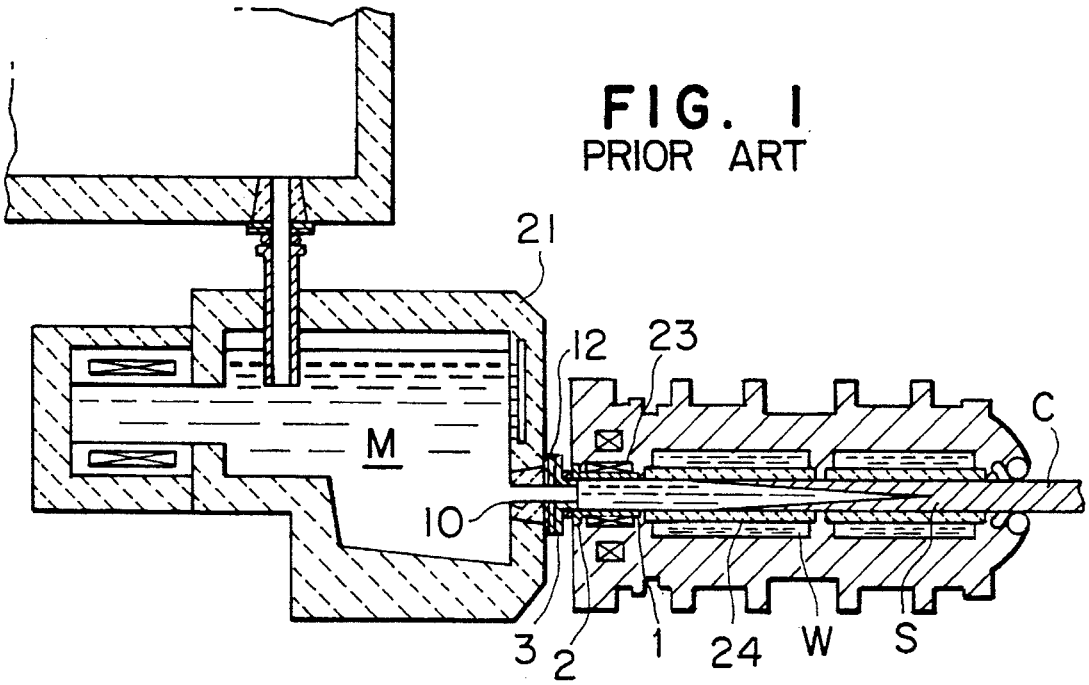
FIG. 1
PRIOR ART
FIG. 2
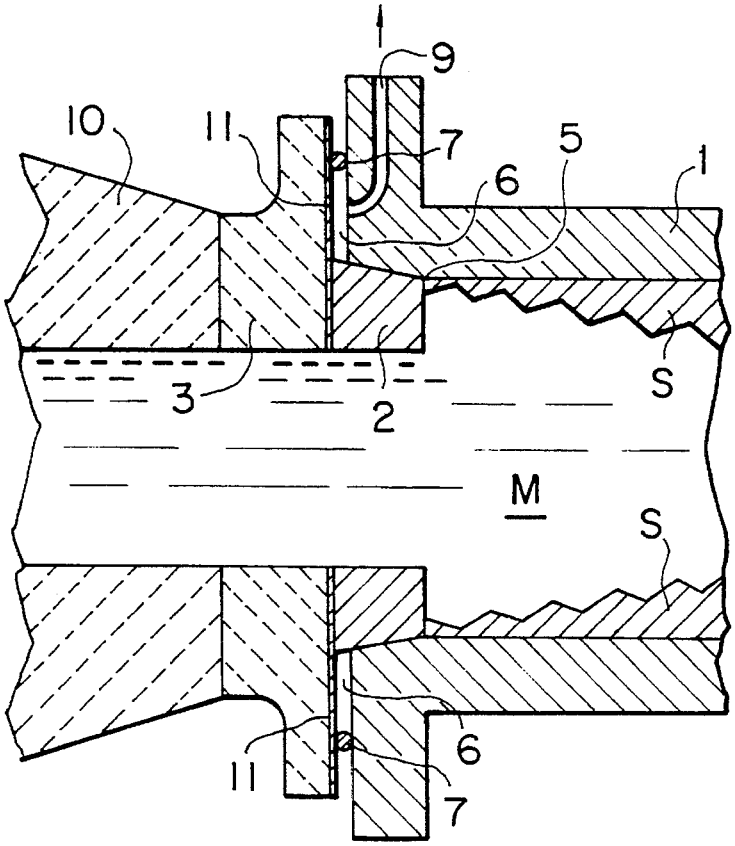

HORIZONTAL CONTINUOUS CASTING METHOD AND APPARATUS

This application is a continuation of Ser. No. 07/793,356 filed as PCT/JP91/00613, May 9, 1991, now abandoned.

TECHNICAL FIELD

This invention relates to a method and an apparatus in horizontal continuous casting which prevent a casting defect, such as a blow hole in a cast piece.

The invention relates particularly to a continuous casting of a billet or the like of carbon steel, stainless steel or other metal.

BACKGROUND ART

An installation cost, an installation space and an operation cost for a horizontal continuous casting apparatus are less than those for a vertical continuous casting apparatus. In addition, no stresses occur due to a bending of a cast piece, and a bulging is less liable to occur because of a small internal pressure of the cast piece. An economic efficiency is good particularly for a casting equipment of a small capacity. Therefore, recently, the horizontal continuous casting apparatuses have been put into practical use for casting billets and the like.

FIG. 1 is a vertical cross-sectional view of a main portion of a horizontal continuous casting apparatus of a general type. As shown in the drawing, in the horizontal continuous casting apparatus, a tundish 21 is connected to a mold 1 via a tundish nozzle 10, a sliding nozzle 12 and a feed nozzle 3. Each of the tundish 21, the tundish nozzle 10, the sliding nozzle 12 and the feed nozzle 3 is made of an ordinary refractory of a zircon type or an alumina type. The mold 1 is composed of a front-stage mold 23 and a rear-stage mold 24, and is cooled by cooling water W. The front-stage mold 23 is made of copper, and a break ring 2 is mounted on the inlet side thereof. The break ring 2 is made of heat-resistant ceramics such as boron nitride and silicon nitride. The rear-stage mold 24 is made of graphite. Depending on the type of apparatus, the sliding nozzle 12 may not be provided.

A molten material M supplied into the mold 1 is cooled by the inner peripheral surface of the mold to form a solidification shell S. The formation of the solidification shell S begins uniformly in its cross-section due to the break ring 2. The break ring 2 prevents the solidification shell S from growing in a reverse direction, that is, toward the feed nozzle 3. A cast piece C, formed as a result of solidification of the molten material M, is intermittently withdrawn from the outlet side of the mold 1 by a withdrawing device (not shown) such as pinch rolls. When the cast piece is intermittently withdrawn, a space is formed between the break ring 2 and the end of the solidification shell S, and a fresh supply of the molten material M flows into this space to form a fresh solidification shell S.

The above space is under a negative pressure, and the sliding nozzle 12 and the feed nozzle 3, as well as the feed nozzle 3 and the break ring 2, are merely joined together at their end surfaces, and the front-stage mold 23 and the break ring 2 are merely fitted together. Therefore, the air intrudes into the space through these joint surfaces. The intruding air is included in the molten material M, and remains in the surface or the interior of the cast piece to be a cause for a casting defect such as a blow hole.

In order to solve this problem, there is provided a horizontal continuous casting apparatus as disclosed in Japanese Patent Unexamined Publication No. 58-74256 and Japanese Patent Unexamined Publication No. 59-66959.

The horizontal continuous casting apparatus of Japanese Patent Unexamined Publication No. 58-74256 comprises a ladle and a tundish disposed beneath it, and a sealed chamber surrounded by a seal member is provided between the bottom surface of the ladle and the upper surface of the tundish. A mold is, together with a nozzle, integral with the tundish and inert gas is supplied into the above sealed chamber. In this apparatus, the inert gas prevents the air from intruding into the tundish, the nozzle, the mold and the like.

The horizontal continuous casting apparatus of Japanese Patent Unexamined Publication No. 59-66959 comprises a device including a seal cover portion covering a nozzle and at least part of the boundary surface between the nozzle and a mold, and an inert gas injection device covering the nozzle and the boundary surface to provide a gas seal. In this apparatus, in the vicinity of the inlets of the nozzle and the mold, the molten metal of elevated temperatures is prevented by the inert gas from coming into contact with the atmosphere.

There exists a horizontal continuous casting apparatus in which in order to facilitate the exchange and maintenance of a nozzle, a break ring or a mold, one of a tundish and the mold is movable whereas the other is fixed. In such an apparatus, the movable side is driven by a hydraulic cylinder or the like to advance to be connected to the fixed side. For example, in a horizontal continuous casting apparatus disclosed in Japanese Patent Unexamined Publication No. 53-88630, a carriage carrying a tundish is driven by a hydraulic cylinder to advance, so that a tundish nozzle is connected to a mold via a nozzle. In contrast, in a horizontal continuous casting apparatus disclosed in Japanese Patent Unexamined Publication No. 58-168457, a carriage carrying a mold is driven by a hydraulic cylinder to advance to be connected to a tundish via a nozzle.

In any of the above conventional horizontal continuous casting apparatuses, a seal is not provided near the mold inlet, and therefore there is encountered a problem that the air intrudes into the mold as described above, so that a casting defect develops.

Further, in the above conventional horizontal continuous casting apparatus provided with the seal device near the mold inlet, the nozzle and the mold are integral with the tundish or a molten steel reservoir. In addition, the seal device is of such a construction as to seal the jointed portions fixed together. Therefore, if it is intended to apply such a seal device to the casting apparatus in which one of the tundish and the mold is movable, the seal device must be incorporated into the casting apparatus each time the tundish and the mold are connected together, and this requires much labor and time.

Further, the above conventional seal method or device, using the inert gas, is applied to the type of continuous casting apparatus in which the mold is composed of one block. Therefore, the above prior art does not give any suggestion of the seal between the molds where the mold is composed of the front-stage mold and the rear-stage mold.

Further, in the above prior art, if the rear-stage mold is composed of a tubular extension portion (sleeve), the above prior art requires a metal tube covering the tubular extension portion. As a result, the construction becomes complicated, and besides the cast piece is not water-cooled directly by a cooling pipe, so that the cooling efficiency is low.

SUMMARY OF THE INVENTION

Therefore, it is an object of the present invention to prevent gas (the air and the like) near a mold inlet, as well as gas (the air and the like) at a mold joint portion, from intruding into the mold in a horizontal continuous casting, thereby preventing the generation of a casting defect such as a blow hole, and also to seal the inlet side of the mold simultaneously with the connection of the mold to a tundish in a horizontal continuous casting apparatus in which one of the tundish and the mold is movable.

The present invention is also directed to the sealing of a mold joint portion of a simple construction in the horizontal continuous casting apparatus, without preventing the cooling of the mold, so as to effect a pressure reduction.

In a continuous casting using a horizontal continuous casting apparatus wherein a feed nozzle and a mold are connected together through a break ring along a direction of withdrawal of a cast piece, a horizontal continuous casting method of the present invention is characterized in that shield means is provided between the feed nozzle and the mold; and the casting is carried out in a condition in which a space inside the shield means has reduced pressure.

A horizontal continuous casting apparatus of the present invention wherein a feed nozzle and a mold are connected together through a break ring along a direction of withdrawal of a cast piece, comprises shield means provided between the feed nozzle and the mold; a gas suction hole provided in communication with a space inside the shield means; and a gas suction device connected to the gas suction hole.

With the above construction, gas is prevented from intruding from the periphery of the break ring into the mold.

In a continuous casting using a horizontal continuous casting apparatus wherein a tundish and a mold are connected together through a feed nozzle and a break ring along a direction of withdrawal of a cast piece, a horizontal continuous casting method of the present invention is characterized in that there is provided shield means surrounding outer peripheries of the feed nozzle and the break ring; and the casting is carried out in a condition in which a space inside said shield means has reduced pressure.

A horizontal continuous casting apparatus of the present invention wherein one of a tundish and a mold is movable whereas the other is fixed, and a movable side is driven to advance, so that the tundish and mold are connected together through a feed nozzle and a break ring, is characterized by comprising shield means surrounding outer peripheries of the nozzle and the break ring; a gas suction hole provided in communication with a space inside the shield means; and a gas suction device connected to the gas suction hole; wherein the shield means comprises an annular peripheral wall, and an annular gasket with which a front end of the peripheral wall is contacted; and one of the peripheral wall and the annular gasket is mounted on the movable side whereas the other is mounted on a fixed side.

With the above construction, gas is prevented from intruding from the periphery of the break ring and the periphery of the feed nozzle into the mold.

In a continuous casting using a horizontal continuous casting apparatus wherein a plurality of molds are connected together along a direction of withdrawal of a cast piece, a horizontal continuous casting method of the present invention is characterized in that there is provided shield means between a front-stage mold and a rear-stage mold of said plurality of molds; and the casting is carried out in a condition in which a space inside the shield means is reduced in pressure.

A horizontal continuous casting apparatus of the present invention wherein a plurality of molds are connected together along a direction of withdrawal of a cast piece, is characterized by comprising shield means provided between a front-stage mold and a rear-stage mold of the plurality of molds; a gas suction hole provided in communication with a space inside the shield means; and a gas suction device connected to the gas suction hole.

With the above construction, gas is prevented from intruding into the mold from between the front-stage mold and the rear-stage mold.

In a continuous casting using a horizontal continuous casting apparatus wherein a tundish and a mold are connected together through a feed nozzle and a break ring along a direction of withdrawal of a cast piece, a horizontal continuous casting method of the present invention is characterized in that there is provided shield means between the feed nozzle and said mold; there is provided shield means surrounding outer peripheries of the feed nozzle and said break ring; and the casting is carried out in a condition in which a space inside of each of the shield means has reduced pressure.

A horizontal continuous casting apparatus of the present invention wherein one of a tundish and a mold is movable whereas the other is fixed, and a movable side is driven to advance, so that the tundish and the mold are connected together through a feed nozzle and a break ring, is characterized by comprising shield means provided between the feed nozzle and the mold; a gas suction hole provided in communication with a space inside the shield means; a gas suction device connected to the gas suction hole; shield means surrounding outer peripheries of the feed nozzle and the break ring; a gas suction hole provided in communication with a space inside the shield means; and a gas suction device connected to the gas suction hole; wherein the shield means comprises an annular peripheral wall, and an annular gasket with which a front end of the peripheral wall is contacted; and one of the peripheral wall and the annular gasket is mounted on the movable side whereas the other is mounted on a fixed side.

With the above construction, gas is better prevented from intruding into the mold from the periphery of the break ring and the periphery of the feed nozzle.

In a continuous casting using a horizontal continuous casting apparatus wherein a tundish and a plurality of molds are connected together through a feed nozzle and a break ring along a direction of withdrawal of a cast piece, a horizontal continuous casting method of the present invention is characterized in that there is provided shield means between the feed nozzle and a foremost-stage mold of the plurality of molds; there is provided shield means between a front-stage mold and a rear-stage mold of the plurality of molds; and the casting is carried out in a condition in which a space inside of each of the shield means has reduced pressure.

A horizontal continuous casting apparatus of the present invention wherein a tundish and a plurality of molds are connected together through a feed nozzle and a break ring along a direction of withdrawal of a cast piece, is characterized by comprising shield means provided between the feed nozzle and a foremost-stage mold of the plurality of molds; a gas suction hole provided in communication with a space inside the shield means; a gas suction device connected to the gas suction hole; shield means provided between a front-stage mold and a rear-stage mold of the plurality of molds; a gas suction hole provided in communication with a space inside the shield means; and a gas suction device connected to the gas suction hole.

With the above construction, gas is prevented from intruding into the mold from the periphery of the break ring and the periphery of the feed nozzle and also from between the front-stage mold and the rear-stage mold.

In a continuous casting using a horizontal continuous casting apparatus wherein a tundish and a plurality of molds are connected together through a feed nozzle and a break ring along a direction of withdrawal of a cast piece, a horizontal continuous casting method of the present invention is characterized in that there is provided shield means between the feed nozzle and a foremost-stage mold of the plurality of molds; there is provided shield means surrounding outer peripheries of the feed nozzle and the break ring; there is provided shield means between a front-stage mold and a rear-stage mold of the plurality of molds; and the casting is carried out in a condition in which a space inside of each of the shield means has reduced pressure.

A horizontal continuous casting apparatus of the present invention wherein one of a tundish and a mold is movable whereas the other is fixed, and a movable side is driven to advance, so that the tundish and a plurality of molds are connected together through a feed nozzle and a break ring, is characterized by comprising shield means provided between the feed nozzle and a foremost-stage mold of the plurality of molds; a gas suction hole provided in communication with a space inside the shield means; a gas suction device connected to the gas suction hole; shield means surrounding outer peripheries of the feed nozzle and the break ring; a gas suction hole provided in communication with a space inside the shield means; a gas suction device connected to the gas suction hole; shield means provided between a front-stage mold and a rear-stage mold of the plurality of molds; a gas suction hole provided in communication with a space inside the shield means; and a gas suction device connected to the gas suction hole; wherein the shield means surrounding the outer periphery of said break ring comprises an annular peripheral wall, and an annular gasket with which a front end of the peripheral wall is contacted; and one of the peripheral wall and the annular gasket is mounted on the movable side whereas the other is mounted on a fixed side.

With the above construction, gas is better prevented from intruding into the mold from the periphery of the break ring and the periphery of the feed nozzle, and also gas is prevented from intruding into the mold from between the front-stage mold and the rear-stage mold.

The horizontal continuous casting apparatus of the present invention is characterized in that a cooling ring is fixedly mounted on the outer periphery of the feed nozzle, and an annular gasket is provided between said cooling ring and said mold.

With the above construction, a thermal deterioration of the shield means is prevented.

The horizontal continuous casting apparatus of the present invention is characterized in that a seal material is attached to the feed nozzle.

With the above construction, the air permeation of the interior of the feed nozzle is shut off so as to enhance the pressure reduction effect.

A cast piece of a square cross-section (whose one side was 150 mm) having a length of 6 m was prepared according to an embodiment of the present invention best shown in FIG. 2, and was cut a depth of 1 mm at its surface, and the effect of the present invention was evaluated in a quantitative manner by the number of blow holes (bubble) defects appearing at the surface. As a result, although 200 to 1000 blow holes per surface of a cast piece of the above shape were recognized when the pressure in the space 6 outside the break ring was not reduced, it has been found that the number of blow holes confirmed by the above method with respect to the cast piece prepared according to example 1 of the present invention was kept to no more than 10. It has also been found that the number of blow holes confirmed by the above method with respect to a cast piece prepared according to example 2 of the present invention was almost zero. As a result, defects on the surface of the product after subjected to rolling were markedly reduced, and it has been confirmed that the present invention is effective in the casting production of the cast piece of higher quality.

According to another embodiment of the present invention, the pressure in the space inside the shield means is reduced, and the air in the shield means will not intrude into the mold, and therefore a casting defect such as blow hole will not occur in the cast piece. Therefore, the quality of the cast piece and the yield rate are improved, and the operation for eliminating the defects can be omitted.

When the mold is connected to the tundish, the distal end of the peripheral wall comes in contact with the annular gasket, so that the air-tightness in the shield means is automatically maintained. Therefore, there is required no operation for sealing the mold inlet side.

Further, the construction of the apparatus is simple, and the present invention can be easily applied to an existing equipment.

According to another embodiment of the present invention, the inside of the annular gasket inserted between the front-stage mold and the rear-stage mold in surrounding relation to the cast piece has reduced pressure. Therefore, the air inside the annular gasket is prevented from intruding into a gap between the inner peripheral surface of the mold and the solidification shell, thereby preventing a casting defect, such as a blow hole bubble, from occurring in the cast piece. Further, the seal device for the mold joint portion is simple, and the present invention can be easily applied to an existing equipment.

According to still another embodiment of the present invention, the annular gasket and the periphery thereof are cooled by the hollow cooling ring, and therefore the annular gasket is kept at a temperature below its heat-resistant limit, and will not be deteriorated by the heat. Therefore, the air-tightness between the joint portion between the mold and the break ring is maintained, and the air is prevented from intruding into the mold from the joint portion. With this arrangement, a casting defect such as cells is prevented, and therefore the quality of the cast piece and the yield rate are improved, and also the operation of eliminating the defect can be omitted.

According to further embodiment of the present invention, the tundish-side end surface, the outer peripheral surface and the mold-side end surface of the feed nozzle, which allow the air to pass therethrough, are covered with the seal material such as a stainless steel foil. Therefore, the ambient air will not be drawn into the inside of the feed nozzle or into the mold through the pores of the nozzle body. Therefore, the oxidation of the molten material and a casting defect such as a blow hole are prevented, and the quality of the cast piece and the yield rate are improved, and also the operation of eliminating the defect can be omitted.

BRIEF DESCRIPTION OF THE DRAWINGS

FIG. 1 is a vertical cross-sectional view of a horizontal continuous casting apparatus of a general type to which the present invention is applied;

FIG. 2 is a cross-sectional view of that portion including a break ring, showing one embodiment of the present invention;

BEST MODE FOR CARRYING OUT THE INVENTION

Figure 3:
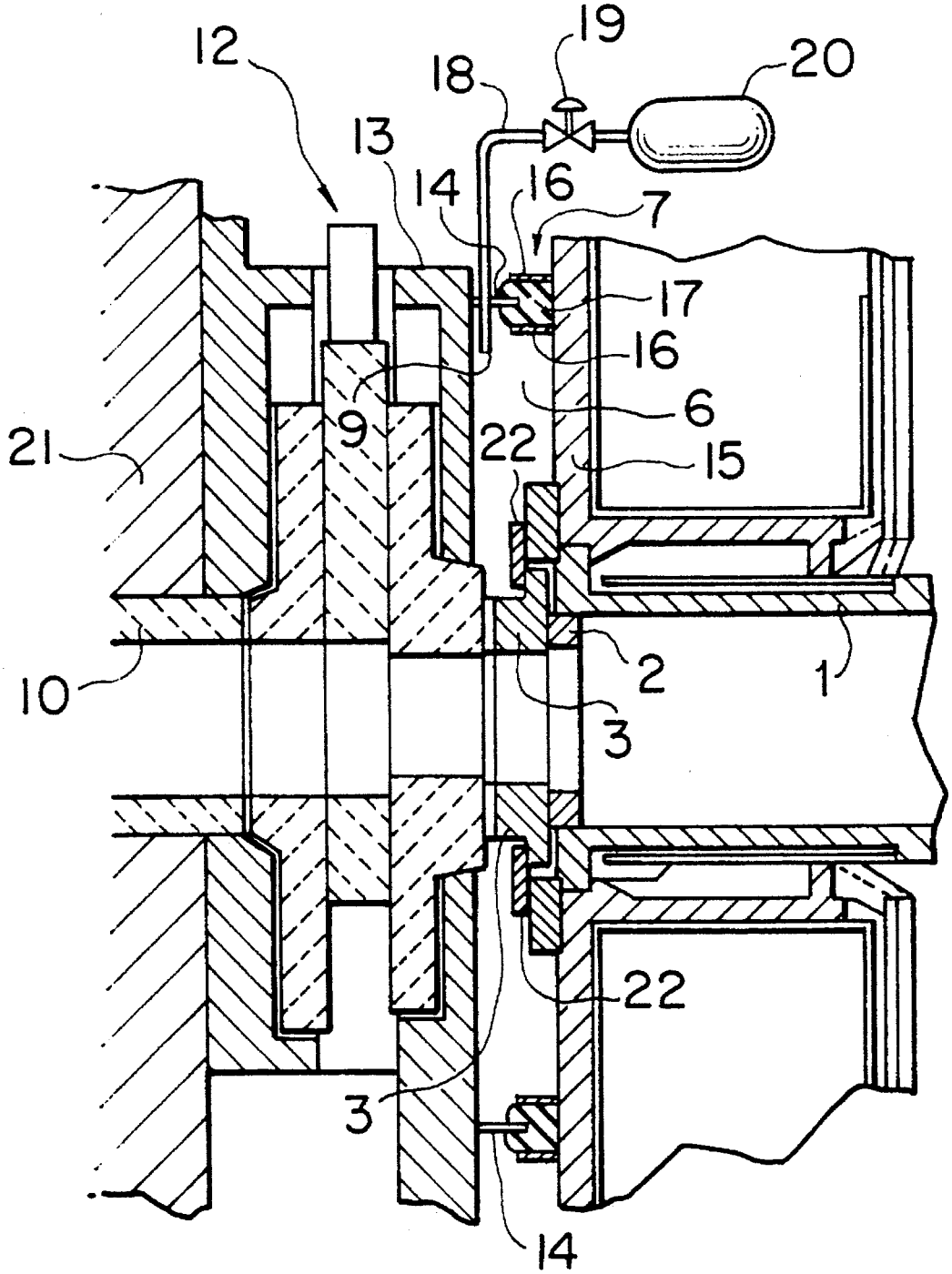
FIG. 3 is a cross-sectional view of that portion including a break ring, showing another embodiment of the present invention.

Details of the present invention will now be described by way of embodiments shown in the drawings. FIG. 2 shows first embodiment of the present invention. In this Figure, a mold 1 is connected to a feed nozzle 3 through a break ring 2, and an annular gasket 7 serving as a shield means is provided to form a seal between the mold 1 and the feed nozzle 2. A space 6 around the outer periphery of the break ring 2 is sealed by the annular gasket 7. A gas suction hole 9 is formed in the mold 1, and one end of the gas suction hole 9 communicates with the space 6, and the other end thereof is connected to a vacuum pump (not shown) serving as a gas suction device.

At the time of a casting operation, a molten material M is usually supplied from a molten material supply device such as a tundish nozzle 10, and flows into the mold 1. The molten material M is then cooled upon contact with the mold 1 to form a solidification shell S. The solidification shell S is intermittently withdrawn by a cast piece withdrawing device such as pinch rolls. As a result, a space is formed in a triple point-neighboring portion 5, and a fresh supply of molten material M flows into this space, and is cooled by the mold 1 to form a fresh shell, thus continuing the casting.

Usually, the mold 1 is made of a material having a good thermal conductivity, and the break ring 2 is made of a material of a relatively poor thermal conductivity, such as a refractory material. Therefore, because of the difference in thermal expansion characteristics between the two, a gap develops between the mold 1 and the break ring 2 during the casting. Also, a gap may develop due, for example, to a machining accuracy of the break ring 2. Usually, since the surface level of the molten material M is disposed above the mold 1, the pressure of the molten material M is higher than the atmospheric pressure, and therefore gas will not intrude from the exterior into the molten material M; however, when the end portion of the solidification shell S moves away from the triple point-neighboring portion 5 at the time of the above intermittent withdrawal, the solidification shell S is torn off from the break ring 2, so that a negative pressure close to vacuum is instantaneously produced at the triple point-neighboring portion 5. At this time, a pressure differential develops between the space 6 outside the break ring 2 and the triple point-neighboring portion 5, and the gas from the space 6 intrudes to the triple point-neighboring portion 5 through a gap between the joined surfaces of the mold 1 and the break ring 2, thereby causing bubbles to develop in the cast piece. According to this embodiment of the present invention, the pressure in the space 6 outside the break ring is reduced during the casting. Therefore, when the negative pressure is produced at the triple point-neighboring portion 5 as a result of withdrawing the solidification shell S, the pressure difference between that in the space 6 outside the break ring and at the triple point-neighboring portion 5, which constitutes the drive force for the bubble intrusion, hardly occurs. Therefore, the gas will not intrude from the space 6 outside the break ring, so that bubbles are prevented from developing in the cast piece.

In the above method, in the case where the feed nozzle 3 is made of a material of a good gas permeability, the pressure in the space 6 can not be reduced efficiently. In this case, by attaching a metal plate 11 to that surface of the feed nozzle 3 directed toward the space 6, the pressure reducing effect can be enhanced.

In order to prevent the bubble intrusion, it is no doubt effective that the pressure of the space 6 outside the break ring should be close to 0 Torr; however, even if the pressure is higher than that level, the bubble reduction effect can be obtained by reducing the pressure to a certain level lower than the atmospheric pressure.

When the negative pressure close to vacuum instantaneously develops at the triple point-neighboring portion 5 as described above, the gas intrudes through the gap between the mold 1 and the break ring 2; however, immediately after this, the pressure of the triple point-neighboring portion 5 is restored by the molten steel head to a level higher than the atmospheric pressure. Therefore, at this time, the molten material M tends to flow into the space 6 outside the break ring through the gap between the mold 1 and the break ring 2. However, since the molten material M entering the gap between the mold 1 and the break ring 2 is very thin, this molten material is immediately cooled by the mold 1 to be solidified. Therefore, the molten material M hardly leaks through the gap between the mold 1 and the break ring 2.

FIG. 3 shows another embodiment of the present invention, directed to a horizontal continuous casting of a billet. These parts similar to those shown in the above-described drawings are designated by identical reference numerals, respectively, and detailed explanation thereof will be omitted.

A peripheral wall 14 of a steel plate is secured by welding to a front end surface of a frame 13 of a sliding nozzle 12. On the other hand, an annular double wall 16 of a steel plate is secured by welding to a frame 15 of a mold 1, facing the frame 13 of the sliding nozzle 12, to form an annular gasket 7 serving as a shield means. A filler 17 made, for example, of kaowool is filled in the annular double wall 16.

A gas suction pipe 18 extends perpendicularly through the peripheral wall 14, and a gas suction hole 9 is disposed in communication with a space 6. A gas suction device 20 is connected to the gas suction pipe 18 via a flow control valve 19. The pressure within the space 6 is reduced by the gas suction device 20 to no more than 50 Torr.

The sliding nozzle 12 is fixedly secured to a tundish 21. A feed nozzle 3 is fixed by a metal holder 22 to the mold 1.

In the type of casting apparatus provided with a plurality of nozzles including a tundish nozzle 10, the sliding nozzle 12 and the feed nozzle 3, all of these nozzles may be surrounded by the shield means, some of these nozzles may be surrounded. In the latter case, at least the nozzle (for example, the feed nozzle) in contact with a break ring should be surrounded by the shield.

The peripheral wall 14 is made of a metal plate such as a steel plate. The height of the peripheral wall 14 is so determined that when the mold 1 is connected to the tundish 21, the distal end of the peripheral wall 14 is held in contact with the annular gasket 7 so as to maintain the air-tightness in the shield means 7.

The peripheral wall 14 and the annular gasket 7 are mounted on the movable side or the fixed side, and for example are mounted on an iron shell of the tundish 21, the frame 13 of the sliding nozzle, or the frame 15 of the mold 1.

The filler 17 of the annular gasket 7 comprises a gasket made of a relatively soft, heat-resistant material such as kaowool and silicone rubber. The front end of the peripheral wall 14 and the annular gasket 7 are moved back and forth relative to each other, and therefore it is preferred that the annular gasket 7 be as thick as from about 20 mm to about 30 mm in order to ensure positive seal. For mounting the annular gasket 7 on the movable side or the fixed side, a gasket groove is provided in the frame 13 or the frame 15.

The annular gasket may be formed by an elastic member such as an O-ring, other than the example shown in FIG. 3.

When the pressure is reduced inside of the shield means it is no more than 50 Torr.

In the horizontal continuous casting apparatus of the above construction, the tundish 21 is driven by a hydraulic cylinder (not shown) and advanced to be connected to the mold 1 through the sliding nozzle 12 and the feed nozzle 3. The front end of the peripheral wall 14 is abutted against the annular gasket 7 to keep the inside of the annular gasket 7 air-tight.

When the gas in the space 6 inside the annular gasket 7 is drawn by the gas suction device 20, the gas in the space 6 is prevented from intruding into the inside of the break ring 2, the feed nozzle 3 or the mold 1.

Therefore, the generation of a casting defect, such as a blow hole, in the cast piece by the intruding gas can be prevented.

In the above embodiment, although the outer peripheries of the feed nozzle 3 and the break ring 2 are surrounded by the shield means (the annular gasket 7), the outer peripheries of the sliding nozzle 12, the feed nozzle 3 and the break ring 2 also be surrounded by shield means. In this case, the peripheral wall 14 is mounted on the iron shell of the tundish 21.

In the above embodiment, although the peripheral wall 14 is mounted on the frame 13 of the sliding nozzle, it may be mounted on the frame 15 of the mold. In this case, the annular gasket 7 is mounted on the frame 13 of the sliding nozzle.

In the type of horizontal continuous casting apparatus in which the tundish 2 and a plurality of molds are connected together along the direction of withdrawal of the cast piece, the peripheral wall 14 or the annular gasket 7 is mounted on the frame of the foremost-stage mold of the plurality of molds.

In the horizontal continuous casting of billets (square shape whose one side was 150 mm) of SUS 303 stainless steel by the use of the apparatus shown in FIG. 3, Table 1 shows examples of the present invention in which the pressure was reduced inside of the annular gasket and comparative examples in which the pressure reduction was not effected.

TABLE 1

| Kind | No. | Degree of vacuum (Torr) | Number of blow holes in cast piece |
|---|---|---|---|
| Examples of this invention | 1 | 150 | 1/m (four surfaces) |
| | 2 | 100 | 0 |
| | 3 | 70 | 0 |
| | 4 | 200 | 2/m (four surfaces) |
| | 5 | 450 | 5/m (four surfaces) |
| Comparative Examples | 6 | 760 (atmospheric pressure) | 200/m (four surfaces) |
| | 7 | 760 (atmospheric pressure) | 150/m (four surfaces) |
| | 8 | 760 (atmospheric pressure) | 250/m (four surfaces) |

Figure 4:
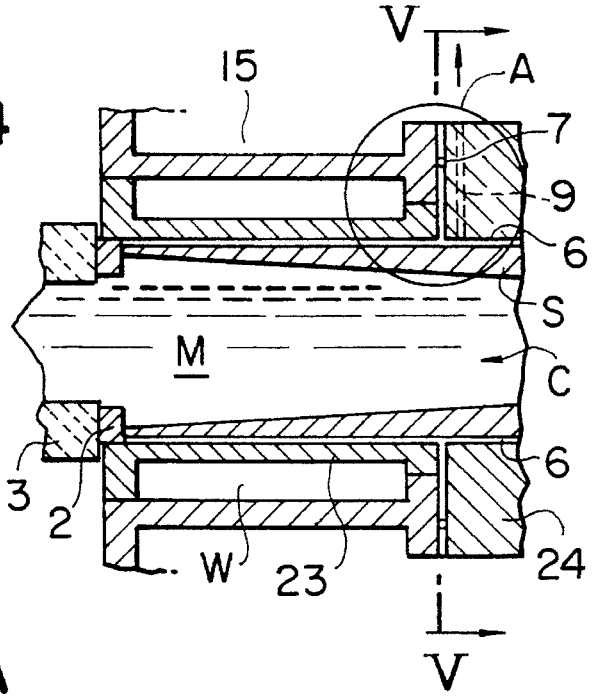
FIG. 4 is a cross-sectional view of that portion including a break ring, showing further embodiment of the present invention.
Figure 4A:
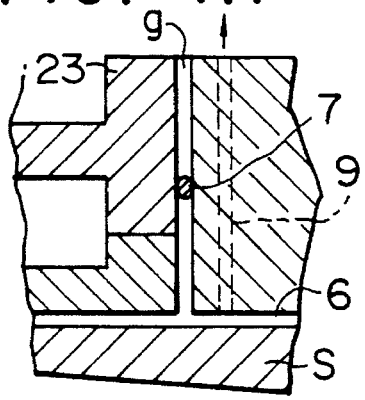
FIG. 4A is an enlarged view of a portion A of FIG. 4.
Figure 5:
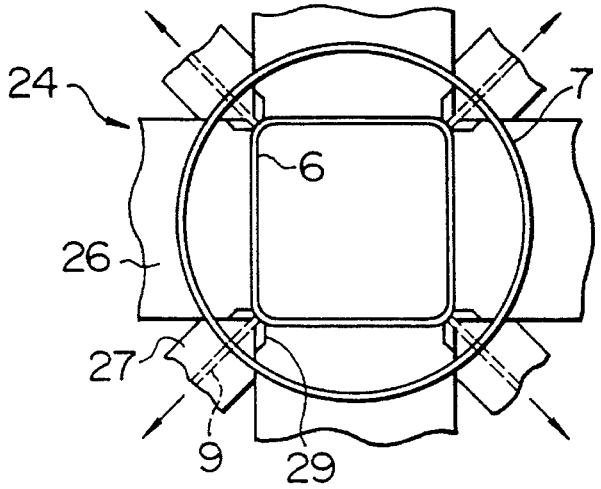
FIG. 5 is a cross-sectional view taken along line V–V of FIG. 4.
Figure 6:
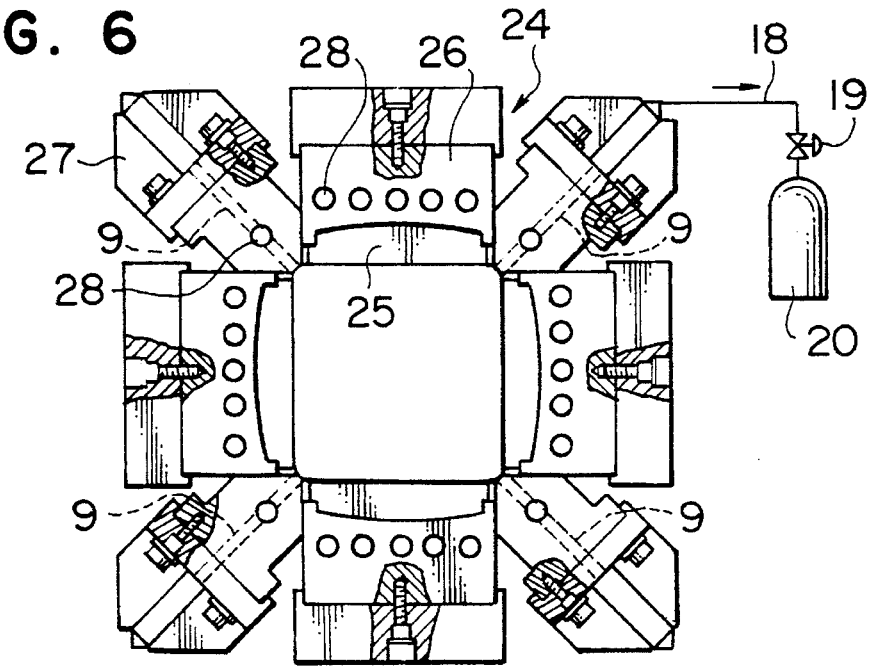
FIG. 6 is a front-elevational view showing details of a rear-stage mold.

FIGS. 4 to 6 show still another embodiment of the present invention, directed to a horizontal continuous casting of a billet. Parts similar to those shown in the above-described drawings are designated by identical reference numerals, respectively, and detailed explanation thereof will be omitted.

An annular gasket 7 of a silicone rubber is inserted in a gap g between a frame 15 of a front-stage mold 23 and a rear-stage mold 24 in surrounding relation to a cast piece C, and is held between the frame 15 and the rear-stage mold 24.

As shown in FIG. 6, the rear-stage mold 24 comprises four peripheral wall blocks 26 each holding a graphite plate 25, and corner blocks 27 each disposed between respective two adjacent peripheral wall blocks 26. The peripheral wall block 26 and the corner block 27 are respectively made of copper and steel, and have cooling water flow passages 28. A gas suction hole 9 extends through the corner block 27 in perpendicular relation to the cooling water flow passage 28. The gas suction holes 9 are provided in the four corner portions, respectively, and although the area of flow thereof is preferably as large as possible in order to increase the degree of pressure reduction, the sum of the areas of flow thereof is 200 $mm^2$ in this embodiment. A gas suction device 20 is connected to the gas suction hole 9 via a gas suction pipe 18.

The joint portion between the peripheral wall block 26 and the corner block 27 is completely sealed by a silicone seal material 29 shown in FIG. 5. A space 6 communicates with the exterior at the mold outlet end (not shown) via a gap between a solidification shell S and the graphite plates 25, and therefore at the time of the suction, the air enters through this gap; however, since the suction ability is extremely larger as compared with the amount in the inflow, the pressure of the space 6 is reduced to no more than 200 Torr. Therefore, the air existing in the space 6 between the solidification shell S and the front-stage mold 23 becomes very thin, thereby suppressing the generation of a blow hole.

Figure 7:
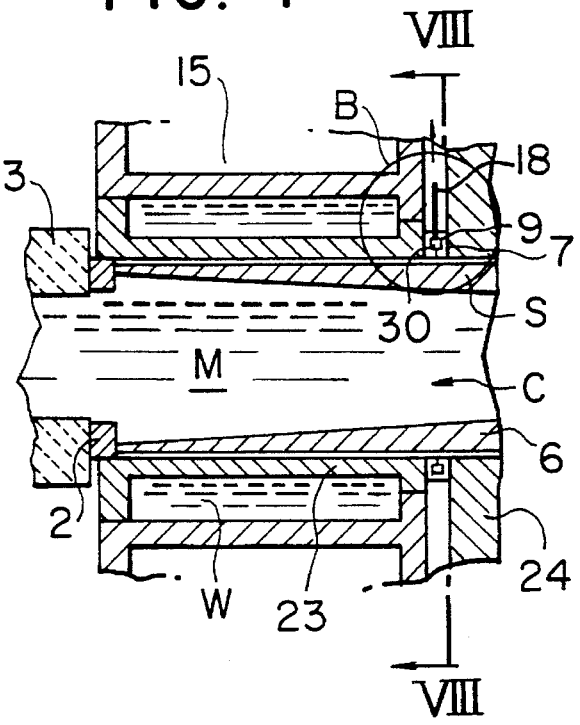
FIG. 7 is a vertical cross-sectional view of other embodiment of the present invention, showing that portion from a feed nozzle to a rear-stage mold.
Figure 7A:
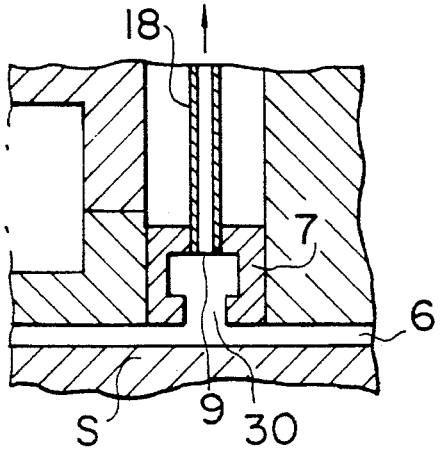
FIG. 7A is an enlarged view of a portion B of FIG. 7.
Figure 8:
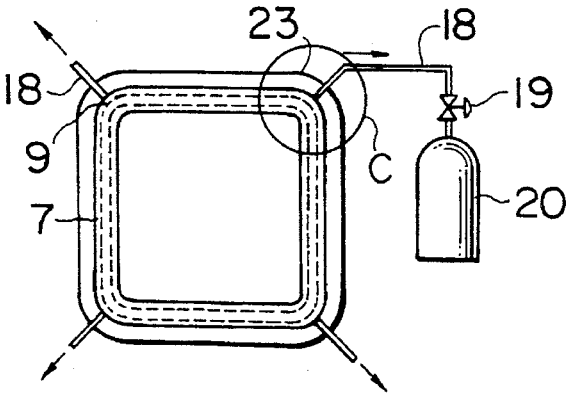
FIG. 8 is a cross-sectional view taken along line VIII—VIII of FIG. 7.
Figure 8A:
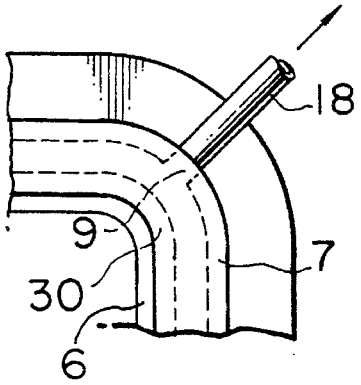
FIG. 8A is an enlarged view of a portion C of FIG. 8.

FIGS. 7 and 8 show an further embodiment of the present invention.

An annular gasket 7 of stainless steel is inserted between a front-stage mold 23 and a rear-stage mold 24 in surrounding relation to a cast piece C, and is held between the two molds 23 and 24. A slit 30 is formed in the inner peripheral surface of the annular gasket 7 over the entire periphery thereof. Gas suction holes 9 are provided in the four corners of the outer periphery, respectively, and a gas suction pipe 18 is connected to each of them.

As in the above embodiment, the areas of flow of the slit 30 and the gas suction holes 9 are 200 $mm^2$. As in the above mentioned embodiment, a space 6 communicates with the exterior at the mold outlet end (not shown) via a gap between a solidification shell S and graphite plates 25, and therefore at the time of the suction, the air enters through this gap; however, since the suction ability is extremely large as compared with the amount of the inflow, the pressure of the space 6 is reduced to no more than 200 Torr. Therefore, the air existing in the space 6 between the solidification shell S and the front-stage mold 23 becomes very thin, thereby suppressing the generation of a blow hole.

In the above embodiments, the annular gasket 7 serving as a shield means is provided between the front-stage mold 23 and the rear-stage mold 24. In the case where another mold is further connected to the rear-stage mold, a shield means may be provided between these molds.

It is preferred that an ordinary material having suitable elasticity and heat-resistance (for example, an O-ring of silicone rubber) be used as the annular gasket 7. In order to make the pressure reduction effect of the gas suction device as effective as possible, all of those portions of the structure communicating with the exterior, such as the contact surfaces of the molds of the assembling type, should preferably be sealed. In the case where the above measures are taken, it is preferred that the pressure inside the annular gasket should be as close to vacuum as possible, and should be at least no more than 200 Torr.

In the horizontal continuous casting of billets (square shape whose one side was 150 mm) of SUS 304 stainless steel by the use of the apparatus shown in FIG. 4, Table 2 shows examples of the present invention in which pressure was reduced inside of the shield means (the annular gasket), and comparative examples in which pressure was not reduced inside of the shield means, or reduced to a lower degree.

TABLE 2

| Kind | No. | Degree of vacuum (Torr) | Number of blow holes in cast piece (number/$m^2$) |
|---|---|---|---|
| Examples of this invention | 1 | 50 | 3 |
| | 2 | 20 | 0 |
| | 3 | 30 | 0 |
| | 4 | 180 | 3 |
| | 5 | 490 | 11 |
| | 6 | 490 | 23 |
| Comparative Examples | 7 | 760 (atmospheric pressure) | 475 |
| | 9 | 500 | 353 |

TABLE 2-continued

| Kind | No. | Degree of vacuum (Torr) | Number of blow holes in cast piece (number/$m^2$) |
|---|---|---|---|
| | 9 | 400 | 378 |

Figure 9:
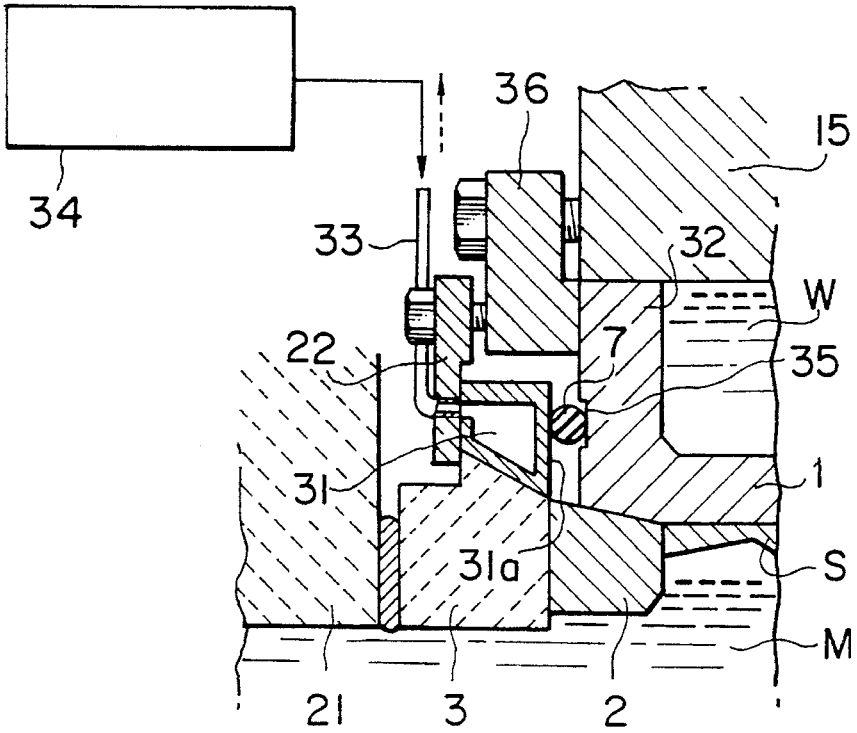
FIG. 9 is a cross-sectional view of that portion including a break ring, showing still another embodiment of the present invention.
Figure 10:
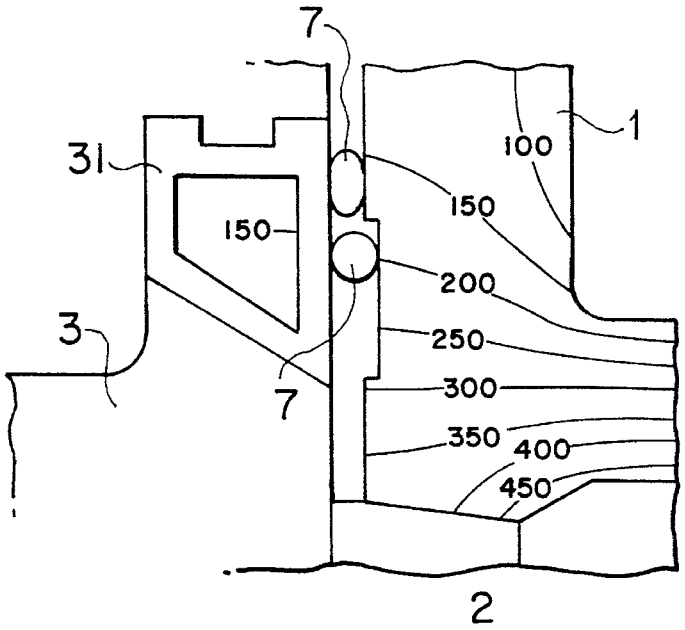
FIG. 10 is a view showing one example of a temperature profile near an annular gasket according to the present invention.

FIGS. 9 and 10 show still another embodiment of the present invention. Parts similar to those shown in the above-described drawings are designated by identical reference numerals, respectively, and detailed explanation thereof will be omitted.

A cooling ring 31 of iron is fitted on an outer periphery of a feed nozzle 3, and is bonded thereto by cement. The interior of the cooling ring 31 is partitioned by partition walls (not shown). In order to enhance the effect of cooling an annular gasket 7 and its surrounding portion, a wide surface 31*a* of the cooling ring 31 faces a side wall 32 of a mold 1. A rear surface of the cooling ring 31 is held by a feed nozzle metal holder 22. A cooling air supply pipe 33 and a cooling air discharge pipe (not shown) are connected to the cooling ring 31. A cooling device 34, comprising a compressor, a cooler and a dehumidifier, is connected to the cooling air supply pipe 33. Cooling air, supplied to the cooling ring 31 from the cooling air supply pipe 33, flows through the interior of the cooling ring 31 generally over an entire periphery thereof to cool this ring, and is discharged to the atmosphere through the cooling air discharge pipe (not shown).

A shallow groove 35 for positioning the annular gasket 7 is formed in the side wall 32 of the mold 1, and the annular gasket 7 is received in this groove. When the mold 1 is connected to a tundish 21, the annular gasket 7 is compressed between the side wall 32 of the mold 1 and the front surface 31*a* of the cooling ring 31 so as to provide a required seal surface pressure.

FIG. 10 shows a temperature profile at that portion adjacent to the annular gasket 7 in the above embodiment. The temperature of the cooling ring is a measured value, and the temperatures of the mold are calculated values. The maximum temperature in the vicinity of the O-ring is around 200° C., and is sufficiently below a limit temperature 270° C. which the annular gasket of silicone rubber can withstand.

Figure 11:
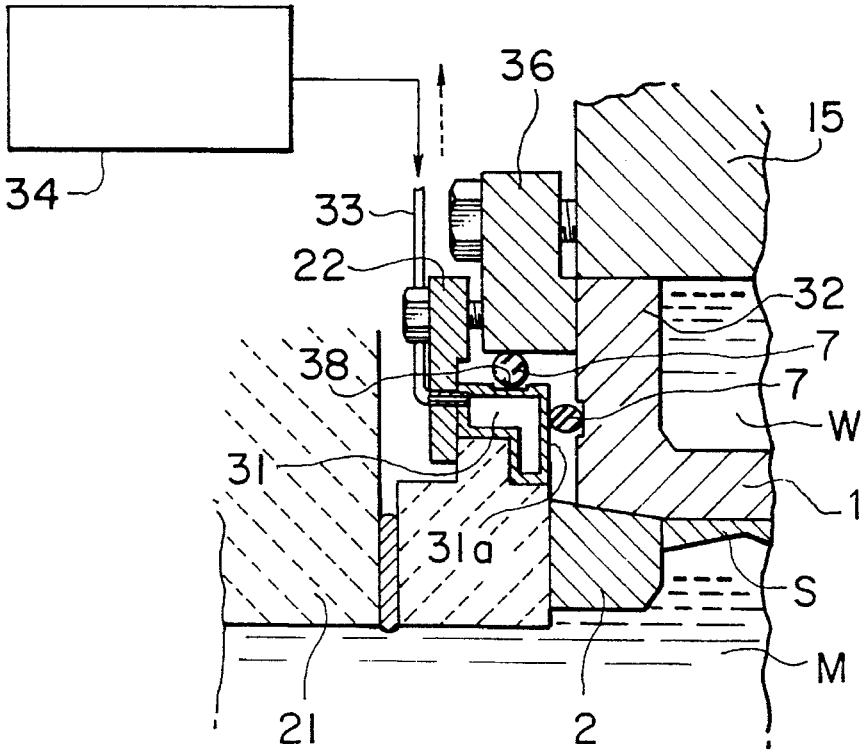
FIG. 11 is a cross-sectional view of that portion including a break ring, showing another embodiment according to the present invention.

FIG. 11 shows a an alternative to the embodiment shown in FIG. 10. This embodiment differs from the first embodiment in that the cross-sectional shape of a cooling ring is different.

The cooling ring 31 has an L-shaped cross-section, and a wide surface 31*a* faces a side wall 32 of a mold 1. A shallow groove 38 for positioning an annular gasket is formed in an outer periphery 37 of the cooling ring 31, and the annular gasket 7 is fitted in this groove. The outer periphery of the annular gasket 7 is held in contact with a mold holder 36. The mold holder 36 fixes mold 1 to frame 15. In this embodiment, since the seal is formed by two annular gaskets 7 and 7, a high air-tightness is obtained.

Figure 12:
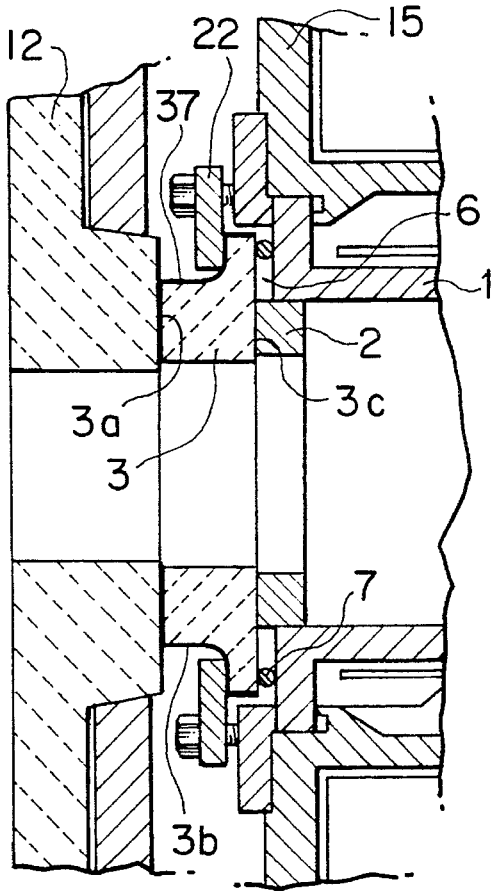
FIGS. 12–14 are cross-sectional views of that portion including a break ring, showing embodiments according to the present invention.
Figure 13:
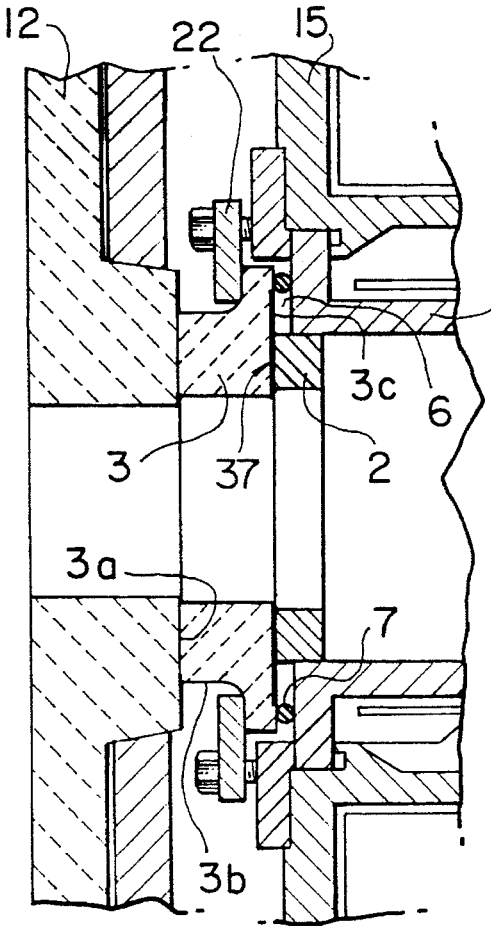
Figure 14:
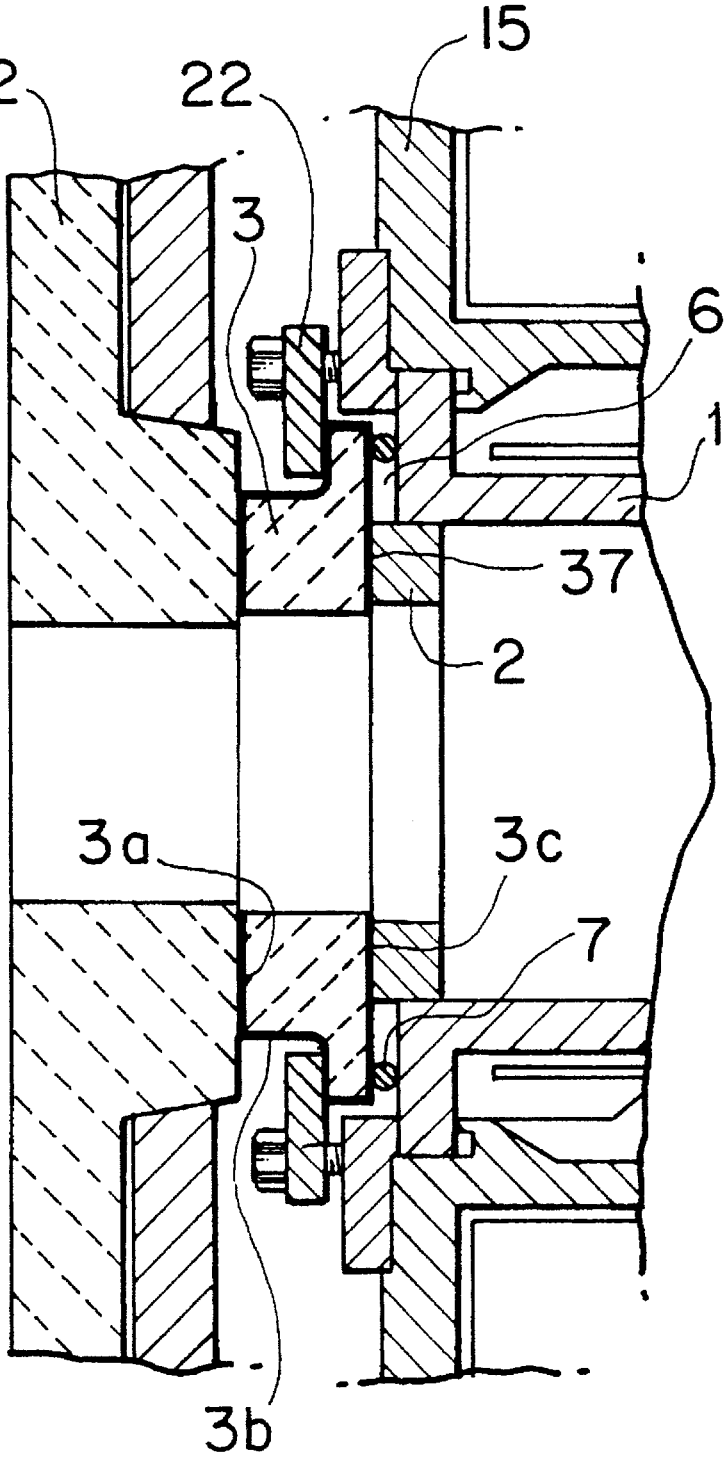

FIGS. 12 to 14 show more embodiments of the present invention. Those parts similar to those shown in the above-described drawings are designated by identical reference numerals, respectively, and detailed explanation thereof will be omitted.

A feed nozzle 3 is fixedly secured by a metal holder 22 to a frame 15 of a mold 1. A tundish-side end surface 3*a* of the feed nozzle 3 is in contact with an end surface of a sliding nozzle 12, and a mold-side end surface 3*c* thereof is in contact with an end surface of a break ring 2. The break ring 2 is interposed between the feed nozzle 3 and the inlet of the mold 1.

In order to prevent the ambient air from intruding through the joint portion between the break ring 2 and the mold 1, an annular gasket 7 of silicone rubber is mounted between the mold-side end surface 3*c* of the feed nozzle 3 and the end surface of the mold 1.

In the embodiment shown in FIG. 12, a stainless steel foil 37 is bonded to the tundish-side end surface 3*a* of the feed nozzle 3, its outer peripheral surface 3*b* and that portion of the mold-side end surface 3*c* disposed outwardly of the annular gasket 7. The thickness of the stainless steel foil 37 is 50 μm.

As described above, the stainless steel foil 37 is attached to the surfaces of the feed nozzle 3 allowing the ambient air to pass therethrough. Therefore, the air will not intrude into the inside of the feed nozzle through the pores of the nozzle body. Also, the air will not intrude into a space 6 sealed by the annular gasket 7, and will not intrude into the mold 1 through the joint portion between the break ring 2 and the mold 1.

In the embodiment shown in FIG. 13, that portion of the mold-side end surface 3*c* of the feed nozzle 3 disposed inwardly of the annular gasket 7 is covered with an annular stainless steel foil 37. In order to prevent the overheating of the annular gasket 7 due to a heat transfer from the stainless steel foil 37, the outer diameter of the annular stainless steel foil 37 is smaller than the inner diameter of the annular gasket 7.

This embodiment is used in the case where the air-tightness between the sliding nozzle 12 and the tundish-side end surface 3*a* of the feed nozzle 3 is high, and the thickness of the nozzle body is large, so that the degree of intrusion of the ambient air from the outer peripheral surface 3*b* is low. The annular stainless steel foil 37 prevents the ambient air from intruding into the space 6 from the relatively-thin portion of the nozzle body.

In the embodiment shown in FIG. 14, the tundish-side end surface 3*a*, the outer peripheral surface 3*b* and the mold-side end surface 3*c* of the feed nozzle 3 are covered with a stainless steel foil 37.

This embodiment is used in the case where the nozzle body of the feed nozzle 3 has a high gaspermeability, and the annular gasket is not exposed to temperatures exceeding its heat-resistant limit.

We claim:

1. A continuous casting method including the steps of:

a) continuously supplying molten metal into a mold through at least one feed nozzle connected to said mold through a break ring, said feed nozzle, said mold and said break ring forming at least a portion of a continuous casting apparatus;

b) intermittently withdrawing a cast piece formed from the molten metal in said mold thereby creating a sub-atmospheric pressure in a space formed at a connecting point between said break ring, said mold and said cast piece as a result of said withdrawal from said mold;

c) placing a shield means between said mold and said feed nozzle to form a sealed-off space to prevent entry of gas into said continuous casting apparatus, wherein said sealed-off space is located between surfaces of the mold, the feed nozzle, the break ring and the shield, and is in fluid communication with said connecting point through a pathway defined by facing surfaces of said break ring and said mold;

d) reducing pressure in said sealed-off space and thereby eliminating a pressure differential between the pressure in said sealed-off space and said sub-atmospheric pressure created in said space formed at said connecting point between said break ring, said mold and said cast piece during said intermittent withdrawal from said mold.

2. A continuous casting method according to claim 1, wherein said apparatus is a horizontal casting apparatus including at least a front-stage and a rear-stage mold section and said method further comprising the steps of:

placing another shield means to seal-off a second space defined between said front-stage and rear-stage mold section; and reducing pressure in said second sealed-off space and thereby eliminating a pressure differential between the pressure in said second sealed-off space and said pressure created in said space formed at said connecting point.

3. A continuous casting apparatus comprising:

a) a mold connected to a feed nozzle through a break ring along a direction of withdrawal of a cast piece;

b) a shield means located between said feed nozzle and said mold to seal-off a space formed between surfaces of said mold, said feed nozzle and said break ring;

c) means communicating with said sealed-off space for reducing pressure in said sealed-off space and for eliminating a pressure differential between the pressure in said sealed-off space and the pressure created in a space formed at a connecting point between said break ring, said mold and said cast piece during intermittent withdrawal of said cast piece from said mold.

4. A continuous casting apparatus according to claim 3, wherein a cooling ring is fixedly mounted on the outer periphery of said feed nozzle, and an annular gasket is provided between said cooling ring and said mold.

5. A casting apparatus according to claim 3, wherein a seal material is attached to said feed nozzle.

6. In a continuous casting process using a continuous casting apparatus having a feed nozzle and a mold connected with each other through a break ring along a direction of withdrawal of a cast piece a method of preventing bubbles formation in said cast piece including the steps of:

a) placing a shield means between said feed nozzle and said mold to seal off a space defined between surfaces of said feed nozzle, said mold, said shield means and said break ring wherein said sealed-off space is in fluid communication with a connecting point between said mold, said break ring, and an end portion of said cast piece through a pathway defined by facing surfaces of said break ring and said mold;

b) providing suction means in communication with said sealed-off space;

c) applying suction through said suction means for eliminating pressure differential between the pressure in said sealed off space and a negative pressure created in a space formed at said connecting point during intermittent withdrawal of said cast piece from said mold to prevent intrusion of any gas from said sealed off space into said cast piece and developing of bubbles in said cast piece.

7. A continuous casting method including the steps of:

a) continuously supplying molten metal from a tundish into a mold connected to each other through at least one feed nozzle and a break ring along a direction of withdrawal of a cast piece;

b) placing a shield means to surround outer peripheries of said at least one feed nozzle and said break ring to seal off a space formed between surfaces of said mold, said tundish and said outer peripheries of said feed nozzle and said break ring wherein said space is in fluid communication with a connecting point between said mold, said break ring, and an end portion of said cast piece through a pathway between said break ring and said mold;

c) providing means in communication with said sealed-off space for removing a pressure differential between the pressure in said sealed-off space and the pressure created in a space formed at said connecting point during intermittent withdrawal of said cast piece from said mold.

8. A continuous casting apparatus comprising:

a tundish for supplying a molten material into a mold for continuously forming at least one cast piece to be intermittently withdrawn from said mold;

one of said tundish and said mold being moveable, and the other being fixed;

a feed nozzle and a break ring located between said tundish and said mold;

means for driving one of said tundish and said mold towards the other, as to connect them together through said feed nozzle and said break ring;

a shield means surrounding outer peripheries of said feed nozzle and said break ring to seal off a space formed between surfaces of said mold, said tundish said shield means and said outer peripheries of said feed nozzle and said break ring, said space being in fluid communication with a connecting point between said break ring, said mold and said cast piece;

providing means in communication with said sealed-off space for removing a pressure differential between the pressure in said sealed-off space and the created pressure in a space formed at said connecting point during its intermittent withdrawal from said mold.

9. A continuous casting apparatus according to claim 8, wherein said shield means comprises an annular gasket and an annular peripheral wall;

the front end of said peripheral wall sealingly connecting with said annular gasket, and wherein one of the other ends of said peripheral wall and of said annular gasket is mounted on the moveable side whereas the other is mounted on the fixed side.

10. A continuous casting apparatus according to claim 8, wherein a cooling ring is fixedly mounted on the outer periphery of said feed nozzle, and an annular gasket is provided between said cooling ring and said mold.

11. A casting apparatus according to claim 8, wherein a seal material is attached to said feed nozzle.

12. A continuous casting apparatus comprising:

a) a plurality of molds connected together along a direction of withdrawal of a cast piece, including at least a front-stage mold and a rear-stage mold;

b) a shield means for sealing-off a space formed between said front-stage mold and said rear-stage mold said sealed-off space being in fluid communication with a space formed at a connecting point between a break ring, the front stage mold and an end portion of said cast piece; and c) means communicating with said sealed-off space for reducing pressure in said sealed-off space and for eliminating a pressure differential between the pressure in said sealed-off space and the pressure created in the space formed at said connecting point during intermittent withdrawal of said cast piece from said mold.

13. A continuous casting method comprising:

a) continuously supplying molten metal into a mold through a feed nozzle and a break ring, said mold including at least a front-stage mold and a rear-stage mold;

b) intermittently withdrawing a cast piece formed from the molten metal in said mold thereby creating a subatmospheric pressure in a space formed at a connecting point between said break ring, said front-stage mold and said cast piece as a result of said withdrawal from said mold;

c) placing a shield means between said mold and said feed nozzle to form a sealed-off space to prevent entry of gas into said continuous casting apparatus, wherein said sealed-off space is defined between surfaces of the mold, the feed nozzle, the break ring and the shield, and is in fluid communication with said connecting point through a pathway between said break ring and the mold;

d) providing means communicating with said sealed-off space for reducing pressure in said sealed-off space and for eliminating a pressure differential between the pressure in said sealed-off space and the subatmospheric pressure created in a space formed at said connecting point during said intermittent withdrawal of said cast piece from said mold;

e) reducing pressure in said sealed-off space and thereby eliminating a pressure differential between the pressure in said sealed-off space and said pressure created in said space formed at said connecting point between said break ring, said mold and said cast piece during said intermittent withdrawal from said mold.

14. A continuous casting method including the steps of:

a) continuously supplying molten metal from a tundish into a mold connected to each other through at least one feed nozzle and a break ring along a direction of withdrawal of a cast piece;

b) intermittently withdrawing a cast piece formed from the molten metal in said mold thereby creating a subatmospheric pressure in a space formed at a connecting point between said break ring, said mold and said cast piece as a result of said withdrawal from said mold;

c) placing a first shield means to seal-off a first space between said at least one feed nozzle, and said mold to prevent entry of gas into said continuous casting apparatus;

d) placing a second shield means to surround outer peripheries of said at least one feed nozzle and said break ring to seal-off a second space formed between surfaces of said mold, said tundish and said outer peripheries of said feed nozzle and said break ring said first and second sealed-off spaces being in fluid communication with said connecting point;

e) providing means in communication with said first and second sealed-off space for removing a pressure differential between the pressure in said first and second sealed-off spaces and the pressure created in a space formed at a connecting point during said intermittent withdrawal of said cast piece from said mold.

15. A continuous casting apparatus comprising:

a tundish for supplying a molten material into a mold for continuously forming at least one cast piece to be intermittently withdrawn from said mold;

one of said tundish and said mold being moveable, and the other being fixed;

a feed nozzle and a break ring located between said tundish and said mold;

means for driving one of said tundish and said mold towards the other, as to connect them together through said feed nozzle and said break ring;

a first shield means located between said feed nozzle and said mold to seal-off a first space formed between surfaces of said mold, said feed nozzle and said break ring;

a second shield means surrounding said outer peripheries of said feed nozzle and said break ring to seal off a second space formed between surfaces of said mold, said tundish and said outer peripheries of said feed nozzle and said break ring said first and second spaces being in fluid communication with a space formed at a connecting point between said break ring, said mold, and said cast piece;

means in communication with said first and second sealed-off spaces for removing a pressure differential between the pressure in said first and second sealed-off spaces and the created pressure in said space formed at said connecting point during intermittent withdrawal of said cast piece from said mold.

16. A continuous casting apparatus according to claim 15, wherein said shield means comprises an annular gasket and an annular peripheral wall;

the front end of said peripheral wall sealingly connecting with said annular gasket, and wherein one of the other ends of said peripheral wall and of said annular gasket is mounted on the moveable side whereas the other is mounted on the fixed side.

17. A continuous casting apparatus according to claim 15, wherein a cooling ring is fixedly mounted on the outer periphery of said feed nozzle, and an annular gasket is provided between said cooling ring and said mold.

18. A casting apparatus according to claim 15, wherein a seal material is attached to said feed nozzle.

19. A continuous casting method including the steps of:

a) continuously supplying molten metal from a tundish into a mold including at least a front-stage mold and a rear-stage mold through at least one feed nozzle connected to said front-stage mold through a break ring;

b) intermittently withdrawing a cast piece formed from the molten metal in said mold thereby creating subatmospheric pressure in a space formed at a connecting point between said break ring, said mold and said cast piece as a result of said withdrawal from said mold;

c) placing a first shield means to seal-off a first space between said at least one feed nozzle and said front-stage mold to prevent entry of gas into said continuous casting apparatus;

d) placing a second shield means to seal-off a second space formed between said at least front-stage and rear-stage mold;

e) placing a third shield means to surround outer peripheries of said at least one feed nozzle and said break ring to seal off a third space formed between surfaces of said front stage mold, said tundish and said outer peripheries of said feed nozzle and said break ring;

f) reducing pressure in said first second and third sealed-off spaces and thereby eliminating a pressure differential between the pressure in said first second and third sealed-off spaces and said subatmospheric pressure created in said space formed at said connecting point between said break ring, said mold and said cast piece during said intermittent withdrawal from said mold.

20. A continuous casting apparatus comprising:

a tundish for supplying a molten material into a mold including at least a front-stage and a rear-stage mold for continuously forming at least one cast piece to be intermittently withdrawn from said mold;

one of said tundish and said mold being moveable, and the other being fixed;

a feed nozzle and a break ring located between said tundish and said mold;

means for driving one of said tundish and said mold towards the other, as to connect them together through said feed nozzle and said break ring;

a first shield means between said feed nozzle and said front-stage mold to seal off a space formed between said front-stage mold, and said at least one feed nozzle;

a second shield means to seal-off a second space between said at least front-stage and rear-stage mold;

a third shield means to surround outer peripheries of said at least one feed nozzle and said break ring to seal-off a third space formed between surfaces of said front-stage mold, said tundish and said outer peripheries of said feed nozzle and said break ring; and means in communication with said first second and third sealed-off spaces for removing a pressure differential between the pressure in said first second and third sealed-off spaces and the pressure created in a space formed at a connecting point between said break ring, said mold and said cast piece during its intermittent withdrawal from said mold.

21. A continuous casting apparatus according to claim 20, wherein a cooling ring is fixedly mounted on the outer periphery of said feed nozzle, and an annular gasket is provided between said cooling ring and said mold.

22. A casting apparatus according to claim 20, wherein a seal material is attached to said feed nozzle.

23. A continuous casting method including the steps of:

a) continuously supplying molten metal into a mold through at least one feed nozzle connected to said mold through a break ring, said feed nozzle, said mold and said break ring forming a part of a horizontal continuous casting apparatus;

b) intermittently withdrawing a cast piece formed from the molten metal in said mold;

c) placing a shield means between said feed nozzle and said mold to seal off a space defined between surfaces of said feed nozzle, said mold said shield means and said break ring;

d) providing suction means in communication with said sealed-off space;

e) applying suction through said suction means for reducing pressure in said sealed-off space and for removing pressure differential between the pressure in said sealed-off space and a pressure created in a space formed at a connecting point between said break ring, said mold and an end portion of a cast piece during intermittent withdrawal of said cast piece from said mold to prevent intrusion of any gas from said sealed off space into said cast piece and developing of bubbles in said cast piece.

* * * * *